US009027627B2

(12) United States Patent
Muto

(10) Patent No.: US 9,027,627 B2
(45) Date of Patent: May 12, 2015

(54) SUNLIGHT-SHIELDING DEVICE

(75) Inventor: Tomonori Muto, Tokyo (JP)

(73) Assignee: Toso Company, Limited, Tokyo (JP)

( * ) Notice: Subject to any disclaimer, the term of this patent is extended or adjusted under 35 U.S.C. 154(b) by 2 days.

(21) Appl. No.: 14/005,141

(22) PCT Filed: Apr. 2, 2012

(86) PCT No.: PCT/JP2012/058931
§ 371 (c)(1),
(2), (4) Date: Oct. 1, 2013

(87) PCT Pub. No.: WO2012/137731
PCT Pub. Date: Oct. 11, 2012

(65) Prior Publication Data

US 2014/0290871 A1 Oct. 2, 2014

(30) Foreign Application Priority Data

Apr. 8, 2011 (JP) ..... 2011-086398

(51) Int. Cl.
*E06B 9/262* (2006.01)
*E06B 9/322* (2006.01)
*E06B 9/38* (2006.01)
*E06B 9/24* (2006.01)

(52) U.S. Cl.
CPC ..... *E06B 9/262* (2013.01); *E06B 2009/2441* (2013.01); *E06B 2009/2452* (2013.01); *E06B 2009/2625* (2013.01); *E06B 9/322* (2013.01); *E06B 9/24* (2013.01); *E06B 9/38* (2013.01)

(58) Field of Classification Search
USPC ..... 160/84.03, 84.02, 84.04, 170, 171, 115, 160/89, 300, 301, 297
IPC ..... E06B 2009/2441,9/262, 9/2625
See application file for complete search history.

(56) References Cited

U.S. PATENT DOCUMENTS 4,662,423 A * 5/1987 Ishii ..... 160/293.1
4,724,885 A * 2/1988 Chang ..... 160/89
5,566,741 A * 10/1996 Ogawara et al. ..... 160/297
(Continued)

FOREIGN PATENT DOCUMENTS

JP H10-292754 A 11/1998
JP 3691373 B2 9/2005
(Continued)

OTHER PUBLICATIONS

International Search Report (ISR) mailed May 22, 2012, issued for International application No. PCT/JP2012/058931.

*Primary Examiner* — David Purol
(74) *Attorney, Agent, or Firm* — Law Office of Katsuhiro Arai

(57) ABSTRACT

A sunlight-shielding device includes two one-way clutches characterized by a short overall length, compact size, simple structure, and fewer parts for a sunlight-shielding device in which two shielding materials suspended from a head box can be switched using a single-loop up/down operation cord. Each one-way clutch includes has an input disk, input plate, top plate, and output drum provided on a center pin in a rotatable manner such that when the input plate rotates in a specified direction due to the rotation from the input disk, an engagement part of the top plate projects along a guide groove and engages with an engagement projection strip of the output drum, to transmit the rotation from the input disk to the output drum.

18 Claims, 12 Drawing Sheets

(56) References Cited

U.S. PATENT DOCUMENTS

| | | | | |
|---|---|---|---|---|
| 6,529,323 | B2 * | 3/2003 | Okumura | 359/461 |
| 7,665,507 | B2 * | 2/2010 | Naoki | 160/308 |
| 7,931,066 | B2 * | 4/2011 | Honda et al. | 160/84.01 |
| 8,079,398 | B2 * | 12/2011 | Tsukamoto | 160/115 |
| 2007/0199663 | A1 * | 8/2007 | Yang | 160/84.04 |

FOREIGN PATENT DOCUMENTS

| | | | |
|---|---|---|---|
| JP | 2008-088626 | A | 4/2008 |
| JP | 4119692 | B2 | 7/2008 |
| JP | 2010-101069 | A | 5/2010 |

* cited by examiner

SUNLIGHT-SHIELDING DEVICE

This application is the U.S. National Phase under 35 U.S.C. §371 of International Application PCT/ JP2012/058931, filed Apr. 2, 2012, which claims priority to Japanese Patent Application No. 2011-086398, filed Apr. 8, 2011. The International Application was published under PCT Article 21(2) in a language other than English.

TECHNICAL FIELD

The present invention relates to a sunlight-shielding device in which two shielding materials suspended from a head box are switched, using a single-loop up/down operation cord, to be moved up and down independently. Here, the sunlight-shielding device refers to a pleated screen device, shutter device, blind device, etc., while the shielding material is a member of any of these devices designed to shield sunlight, being a pleated screen, shutter, blind, etc.

Also, the two shielding materials may be, for example, a top shielding material and bottom shielding material installed above and below an intermediate rail in a twin-type sunlight-shielding device, or an interior-side shielding material and exterior-side shielding material that constitute front/rear double shielding materials.

BACKGROUND ART

A twin-type sunlight-shielding device structured in such a way that a top shielding material and bottom shielding material installed above and below an intermediate rail are switched and moved up and down by operating a single-loop up/down operation cord has heretofore been known (refer to Patent Literature 1).

In addition, a structure whereby double sunlight-shielding materials, one on the interior side and the other on the exterior side, can be pulled up independently using a single operation cord is known, wherein such structure has: a first clutch unit that allows for selection of pulling up the first sunlight-shielding material, letting it drop due to its dead weight, or preventing it from dropping due to its dead weight, by operating the operation cord in one direction; and a second clutch unit that allows for selection of pulling up the second sunlight-shielding material, letting it drop due to its dead weight, or preventing it from dropping due to its dead weight, by operating the operation cord in the other direction (refer to Patent Literature 2).

BACKGROUND ART LITERATURE

Patent Literature

Patent Literature 1: Japanese Patent Laid-open No. 2010-101069

Patent Literature 2: Japanese Patent No. 4119692

SUMMARY OF THE INVENTION

Problems to be Solved by the Invention

The clutch unit in the prior art mentioned above (such as in Patent Literature 2) can pull up the sunlight-shielding material or let it drop due to its dead weight, etc., but because the unit is structured in such a way that a clutch drum moves in the axial direction of a shaft along a guide groove together with a clutch ball, the overall length of the clutch unit increases by the length of movement of the clutch drum, which presents a problem.

The applicant of the present application for patent developed a new clutch mechanism to solve the aforementioned problem, but the mechanism presented a problem in that the number of parts would increase slightly.

The present invention aims to solve the aforementioned problem of the prior art, and the object of the present invention is to realize a sunlight-shielding device comprising a one-way clutch device for switching two shielding materials suspended from a head box using a single-loop up/down operation cord, wherein such one-way clutch is characterized by a short overall length, compact size, simple structure and fewer parts.

Means for Solving the Problems

To achieve the aforementioned object, the present invention provides a sunlight-shielding device comprising: a head box; a first shielding material and second shielding material suspended from the head box and moved up and down by a first up/down cord and second up/down cord, respectively;

a first up/down cord wind-up drum and second up/down cord wind-up drum provided in the head box; and a pulley operation drive device; wherein such sunlight-shielding device is characterized in that:

the pulley operation drive device has a pulley driven and rotated in a selected rotating direction using an operation cord, as well as a first up/down one-way clutch and second up/down one-way clutch that transmit the rotations of the pulley in the opposite direction of first direction and second direction to the first up/down cord wind-up drum and second up/down cord wind-up drum, respectively; the first up/down one-way clutch and second up/down one-way clutch each have an input disk, input plate, top plate, and output drum provided on a center pin in a rotatable manner; the input disk and input plate are coupled with play in between in the rotating direction; the top plate has a guide groove that holds an engagement top in a slidable manner; and the engagement top is pivoted on the input plate and always biased by a return spring provided between the input plate and top plate, via the input plate, in a manner remaining held inside the guide groove of the top plate, but when the input plate rotates in a specified direction via the input disk by the rotational force of the pulley, the engagement top projects from the top plate along the guide groove and engages with an engagement projection strip on the output drum to transmit the rotation of the input plate to the output drum.

Preferably the structure is such that: the input plate has a pivot shaft and drive projection on its inner surface and the engagement top is pivoted on the pivot shaft; the top plate has on its outer surface a guide groove that holds the engagement top in a slidable manner as well as a curved drive projection-receiving groove running in the circumferential direction and also has a regulating projection on its inner surface; a return spring that biases the input plate and top plate in opposite rotating directions is installed between the input plate and top plate; there is a center pin on which a retainer spring for tightening the center pin is wound and the feet on both ends of the retainer spring are positioned on both sides of the regulating projection of the top plate in a contactable manner; and the output drum has an engagement projection strip formed on its inner periphery surface that can engage with the engagement top.

Preferably the structure is such that the output drum has a cylindrical part on the outer side and annular part on the inside, where the cylindrical part has a top plate positioned concentrically in a rotatable manner, formed on the inner periphery surface of the cylindrical part of the engagement projection strip that can engage with the engagement top.

Preferably the structure is such that an engagement projection is formed on the inner periphery surface of the annular part of the output drum, with a drum joint that can rotate within the annular part provided concentrically with the output drum, where the drum joint has a projection formed on it that can engage with the engagement projection of the annular part of the output drum, and the output drum and drum joint are coupled with play in between in the rotating direction.

Preferably the structure is such that: the first up/down one-way clutch and second up/down one-way clutch are connected to the first up/down cord wind-up drum and second up/down cord wind-up drum via a first up/down drive shaft and second up/down drive shaft, respectively; and a first up/down stopper device and second up/down stopper device are provided at positions along the first up/down drive shaft and second up/down drive shaft, respectively.

Preferably the structure is such that: the first up/down stopper device and second up/down stopper device each have a cam shaft fixed coaxially to the first up/down drive shaft or second up/down drive shaft, and a cam case that supports the cam shaft in a rotatable manner; and a cam groove is formed on one of the outer periphery surface of the cam shaft and the cam case while a vertical groove extending straight in the axial direction is formed on the other, with rolling elements inserted in the cam groove and vertical groove, and when the operation cord is operated, the first up/down drive shaft and second up/down drive shaft are controlled to rotate or stop, to allow the first shielding material and second shielding material to be moved up/down or stopped.

Effects of the Invention

According to the present invention, a one-way clutch device characterized by a short overall length, compact size, simple structure, and fewer parts can be realized for a sunlight-shielding device in which two shielding materials suspended from a head box can be switched using a single-loop up/down operation cord.

Additionally, because the one-way clutch device of the sunlight-shielding device proposed by the present invention is structured in such a way that the rotating member on the input side and the rotating member on the output side are coupled in a rotatable manner with play in between, the transmission, to the input side, of the reverse rotation caused by the dropping of the shielding material immediately after stopping of the upward operation of the shielding material can be prevented by means of slipping, so that the shielding material can be lowered without fail and the lowering stopped by the function of the stopper device.

BRIEF DESCRIPTION OF THE DRAWINGS

FIGS. 1*a* and 1*b* are drawings explaining the general structure of the twin-type sunlight-shielding device conforming to the present invention in Example 1, where FIG. 1*a* provides a plan view showing the structure of the head box and an enlarged view of the key parts, while FIG. 1*b* is a front view.

FIG. 2*a* is a drawing explaining the relational structure of the first and second up/down drive shafts, while FIG. 2*b* is a development view of the cam groove.

FIG. 3*a* is a plan view of the wind-up drum device, while FIG. 3*b* is a perspective view showing the first up/down one-way clutch (the second up/down one-way clutch also has roughly the same structure).

FIG. 9*a* is a plan view showing the structure of the head box, FIG. 9*b* is a side view of the sunlight-shielding device as applied to a double pleated screen device, and FIG. 9*c* is a side view of the sunlight-shielding device as applied to a double roll-up curtain device.

MODE FOR CARRYING OUT THE INVENTION

Figure 1A:
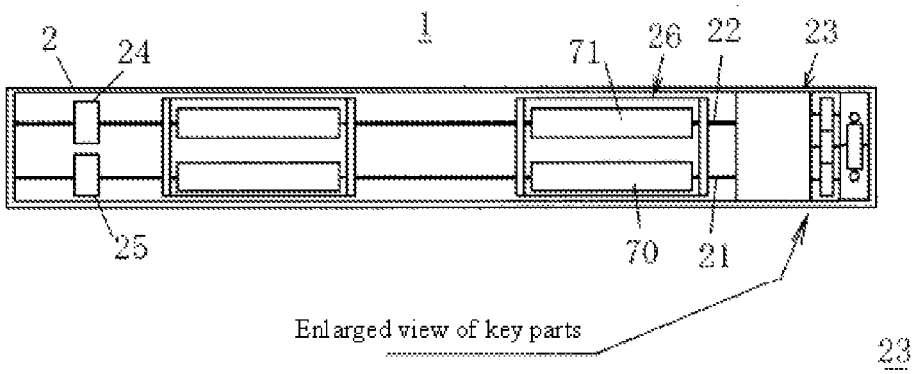

Modes for carrying out the sunlight-shielding device proposed by the present invention are explained below, based on examples, by referring to the drawings.

The sunlight-shielding device proposed by the present invention is a sunlight-shielding device in which two shielding materials suspended from a head box are switched, using a single-loop up/down operation cord, to be moved up and down independently, which can be applied to a pleated screen device, shutter device, blind device, roll-up curtain device, etc. The two shielding materials may be top and bottom shielding materials like those used in a twin-type sunlight-shielding device, or interior-side shielding material and exterior-side shielding material that constitute front/rear double shielding materials.

EXAMPLE 1

In Example 1, an applied structure of sunlight-shielding device, or specifically a twin-type sunlight-shielding device having top and bottom pleated screens (twin-type pleated screen device), is explained. The sunlight-shielding device described later in Example 2 is different from the twin-type sunlight-shielding device in Example 1 having two shielding materials provided at top and bottom, in that the two shielding materials in Example 2 are provided at front and rear in the interior/exterior direction with respect to the window, but other aspects of the structure are the same and conform to Example 1.

Figure 1B:
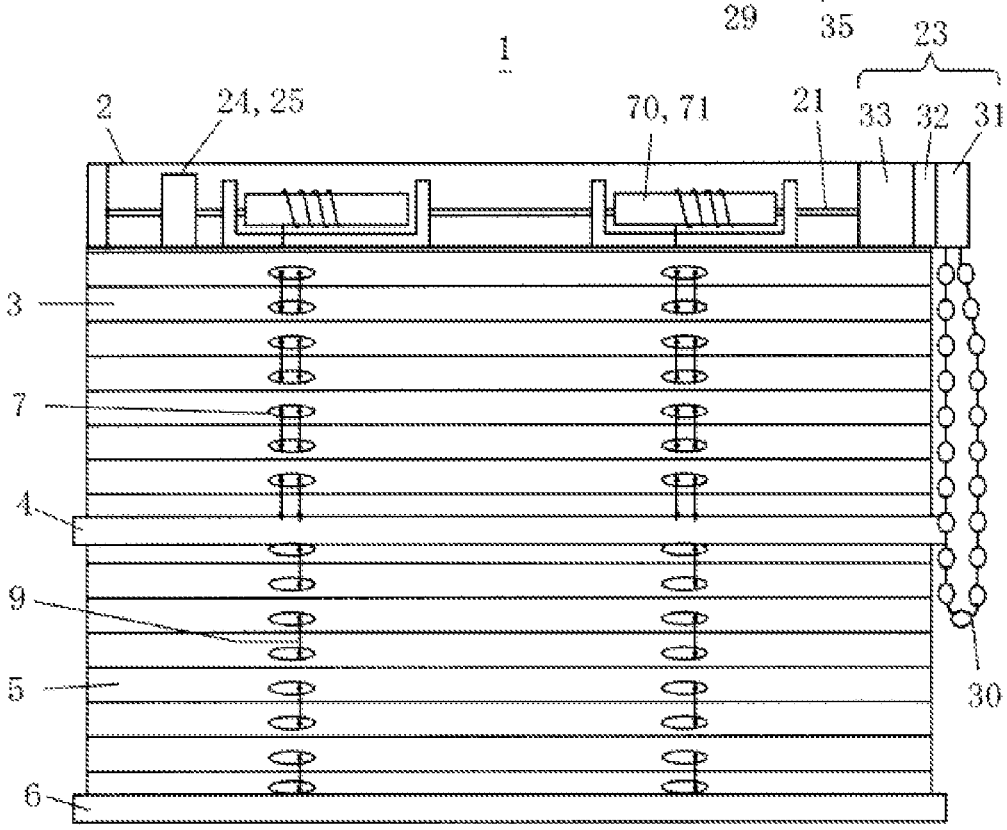

FIG. 1 is a FIGS. 1*a* and 1 *b* are drawings explaining the general structure of a sunlight-shielding device 1 in an example of the sunlight-shielding device proposed by the present invention. As shown in FIG. 1*b*, the sunlight-shielding device 1 has a head box 2, a first shielding material 3 suspended from the head box 2, an intermediate rail 4 attached at the bottom end of the first shielding material 3, a second shielding material 5 whose top end is attached to the intermediate rail 4, and a bottom rail 6 attached at the bottom end of the second shielding material 5.

The first shielding material 3 and second shielding material 5 each have up/down cord holes 7 formed on the left and right. A first shielding material up/down cord 8 (referred to as "first up/down cord" in this Specification) has its bottom end attached to the intermediate rail 4, and extends upward toward the head box 2 through the up/down cord hole 7. A second shielding material up/down cord 9 (referred to as "second up/down cord" in this Specification) has its bottom end attached to the bottom rail 6, and extends upward toward the head box 2 through the up/down cord hole 7.

As shown in FIG. 1*a*, the head box 2 has a first up/down drive shaft 21 and second up/down drive shaft 22 positioned in parallel inside in the front and rear positions relative to each other. A pulley operation drive device 23 for driving the first up/down drive shaft 21 and second up/down drive shaft 22 is provided on one end of the head box 2, and a first up/down stopper device 24 and second up/down stopper device 25 are provided along the first up/down drive shaft 21 and second up/down drive shaft 22, respectively. Twin wind-up drum devices 26, driven and rotated by the driving forces of the first up/down drive shaft 21 and second up/down drive shaft 22, are provided on the left and right.

The pulley operation drive device 23 is a device to drive and rotate the first up/down drive shaft 21 or second up/down drive shaft 22 by pulling an operation cord 30 constituted by a looped ball chain. In Example 1, the first up/down drive shaft 21 and second up/down drive shaft 22 rotate in opposite directions, respectively.

Figure 10:
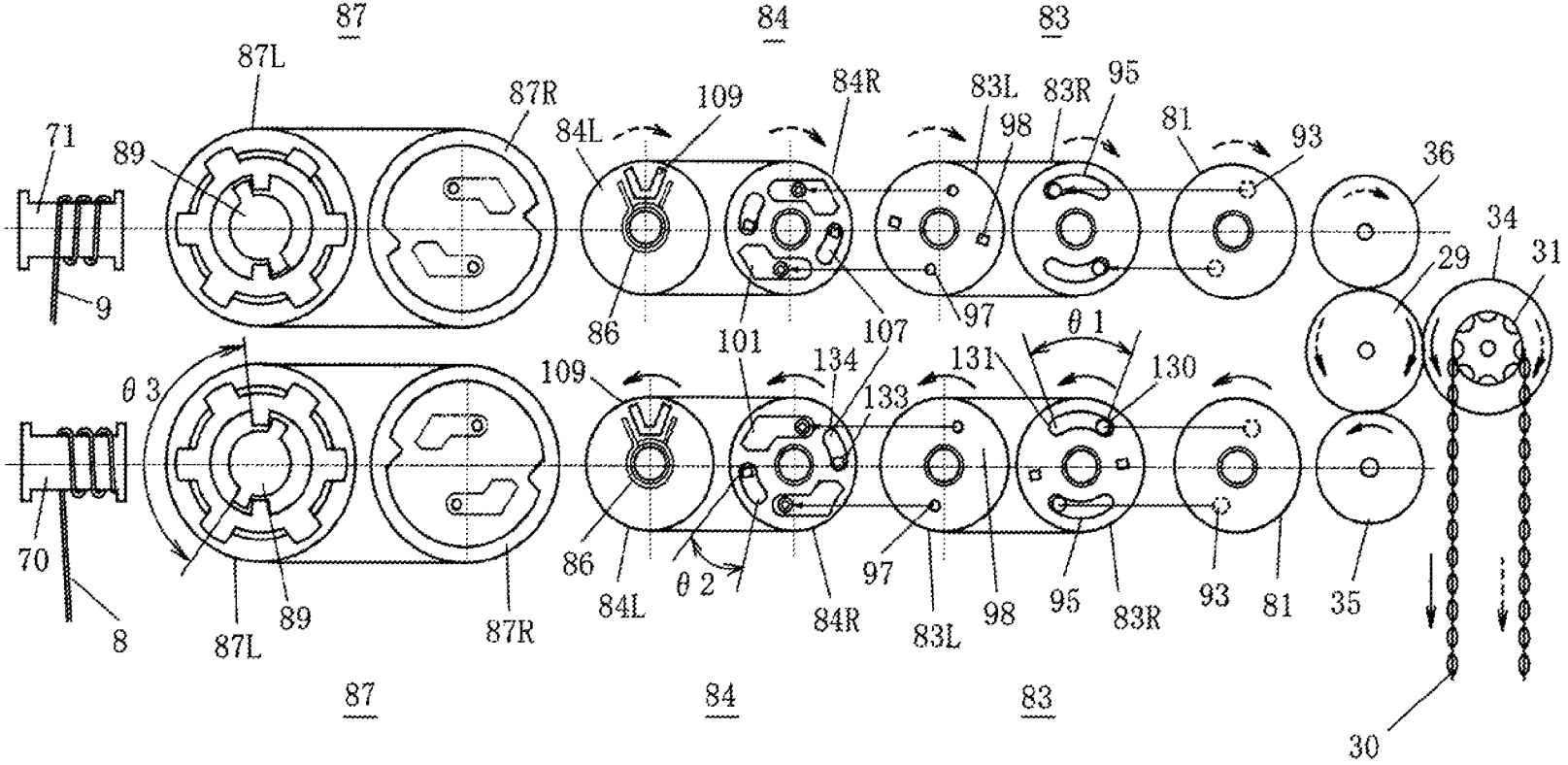
FIG. 10 is a schematic view explaining the operation of the sunlight-shielding device conforming to the present invention in an example.

As shown in FIGS. 1, 10, etc., this pulley operation drive device 23 has a pulley 31, rotational force transmission mechanism 32, and one-way clutch device 33. The pulley 31 has the operation cord 30 hanged thereon and a pulley gear 34 fixed to it coaxially. The rotational force transmission mechanism 32 has an intermediate gear 29 that meshes with the pulley gear 34, as well as a first driving gear 35 and second driving gear 36 that mesh with the intermediate gear 29, respectively.

A one-way clutch device 33 has a first up/down one-way clutch 38 that receives the output from the first driving gear 35 and transmits only the rotation in a first direction (such as counterclockwise direction) to the first up/down drive shaft 21, and a second up/down one-way clutch 39 that receives the output from the second driving gear 36 and transmits only the rotation in a second direction (such as clockwise direction) to the second up/down drive shaft 22. It should be noted that the one-way clutch device 33 is a characteristic part of the sunlight-shielding device under the present invention, and therefore its structure is explained in detail later.

With such pulley operation drive device 23, the operation cord 30 is pulled in one direction (direction of the solid-line arrow in FIG. 10 or 11) to rotate the pulley 31 and pulley gear 34 in the counterclockwise direction (direction opposite the one in which clock hands rotate), for example, and thereby rotate the first driving gear 35 in the counterclockwise direction via the intermediate gear 29, and further rotate the first up/down drive shaft 21 in the counterclockwise direction via the first driving gear 35 and first up/down one-way clutch 38.

Also, the operation cord 30 is pulled in the opposite direction (direction of the broken-line arrow in FIG. 10 or 11) to rotate the pulley 31 and pulley gear 34 in the clockwise direction (direction in which clock hands rotate) and thereby rotate the second driving gear 36 in the clockwise direction via the intermediate gear 29, and further rotate the second up/down drive shaft 22 in the clockwise direction via the second up/down one-way clutch 39.

The first up/down stopper device 24 and second up/down stopper device 25 are provided along the first up/down drive shaft 21 and second up/down drive shaft 22, respectively. The first up/down stopper device 24 and second up/down stopper device 25 have the same structure, so their parts are denoted using the same symbols, and the structure of the first up/down stopper device 24 is explained below.

Figure 2A:
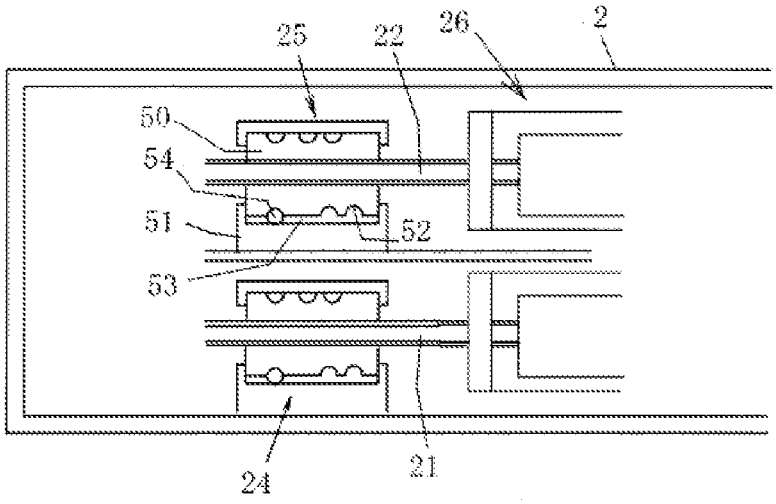
FIGS. 2*a* and 2*b* are drawings explaining the stopper device used in the sunlight-shielding devices conforming to the present invention in Examples 1 and 2, where

As shown in FIG. 2*a*, the first up/down stopper device 24 has a cam shaft 50 fixed coaxially to the first up/down drive shaft 22 and a cam case 51 that supports the cam shaft 50 in a rotatable manner. The cam shaft 50 has a cam groove 52 formed on its outer periphery surface. The cam case 51 has a straight vertical groove 53 formed on its inner periphery surface in the axial direction.

The cam case 51 is fixed to the head box 2. Ball-shaped rolling elements 54 are inserted in a manner movable by rolling in the cam groove 52 and the vertical groove 53 of the cam case 51. Although not illustrated, a cam groove 52 may be provided on the inner periphery surface of the cam case 51 and vertical groove 53 on the outer periphery surface of the cam shaft 50, which is the opposite of the aforementioned structure.

Figure 2B:
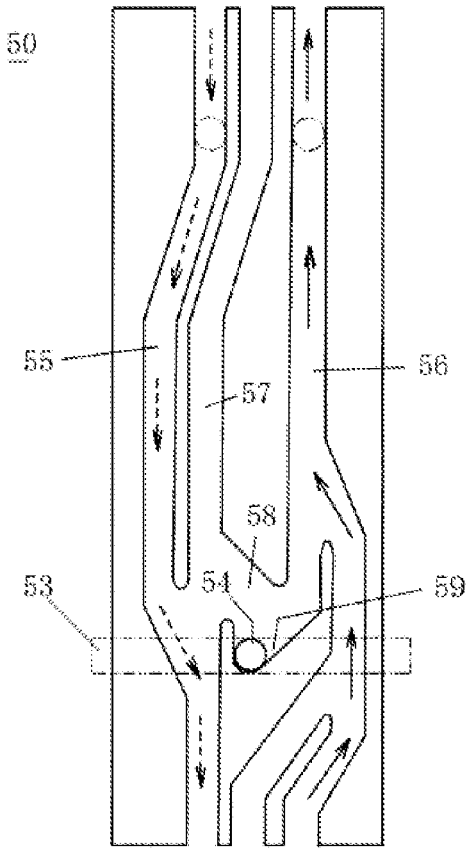

FIG. 2*b* is a development view of the outer periphery surface of the cam shaft 50, and as shown in FIG. 2*b*, the cam groove 52 comprises: an endless left side groove 55 and right side groove 56 extending in the circumferential direction of the cam shaft 50; a coupling groove 57 extending in the circumferential direction between the left side groove 55 and right side groove 56, with one end connected to the left side groove 55 and the other end connected to the right side groove 56; a V-shaped groove 58 formed in the shape of "V," with one end connected to the coupling groove 57 and the other end connected to the right side groove 56; and a concave part 59 formed in a corner located midway along the V-shaped groove 58.

Figure 3A:
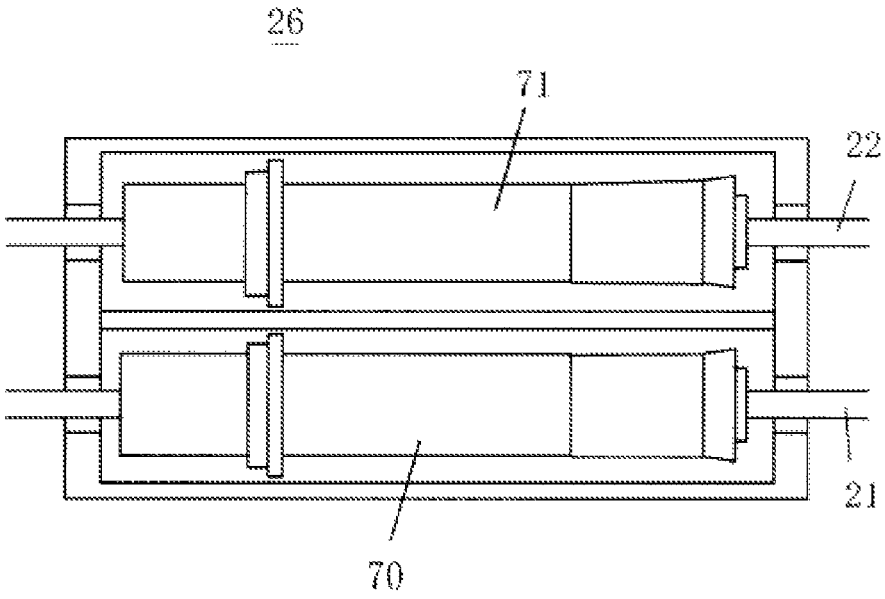
FIGS. 3*a* and 3*b* are drawings explaining a sunlight-shielding device conforming to the present invention, where

As shown in FIGS. 1*a* and 3*a*, etc., the twin wind-up drum device 26 has a first up/down cord wind-up drum 70 and second up/down cord wind-up drum 71 corresponding to the first up/down drive shaft 21 and second up/down drive shaft 22, respectively.

Although not illustrated, a string anti-sagging device may be provided between the pulley operation drive device 23 and twin wind-up drum device 26. The string anti-sagging device is not a characteristic structure of the present invention and thus not explained in this Specification, but patent application No. 2011-83669 was filed regarding this device earlier by the applicant of the present application for patent.

(One-Way Clutch Device)

The one-way clutch device 33 is explained in FIGS. 3 to 12. The first up/down one-way clutch 38 and second up/down one-way clutch 39 both have the same structure and operation, except that the installation direction of an engagement top 101 and orientation of an engagement projection strip 125 described later are opposite, and accordingly the first up/down one-way clutch 38 is explained below as representative of the two.

Figure 3B:
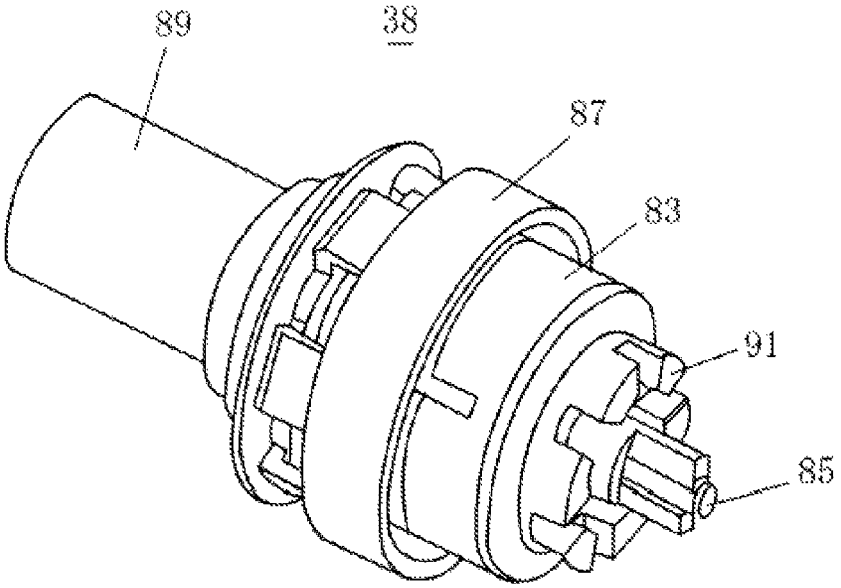
Figure 4:
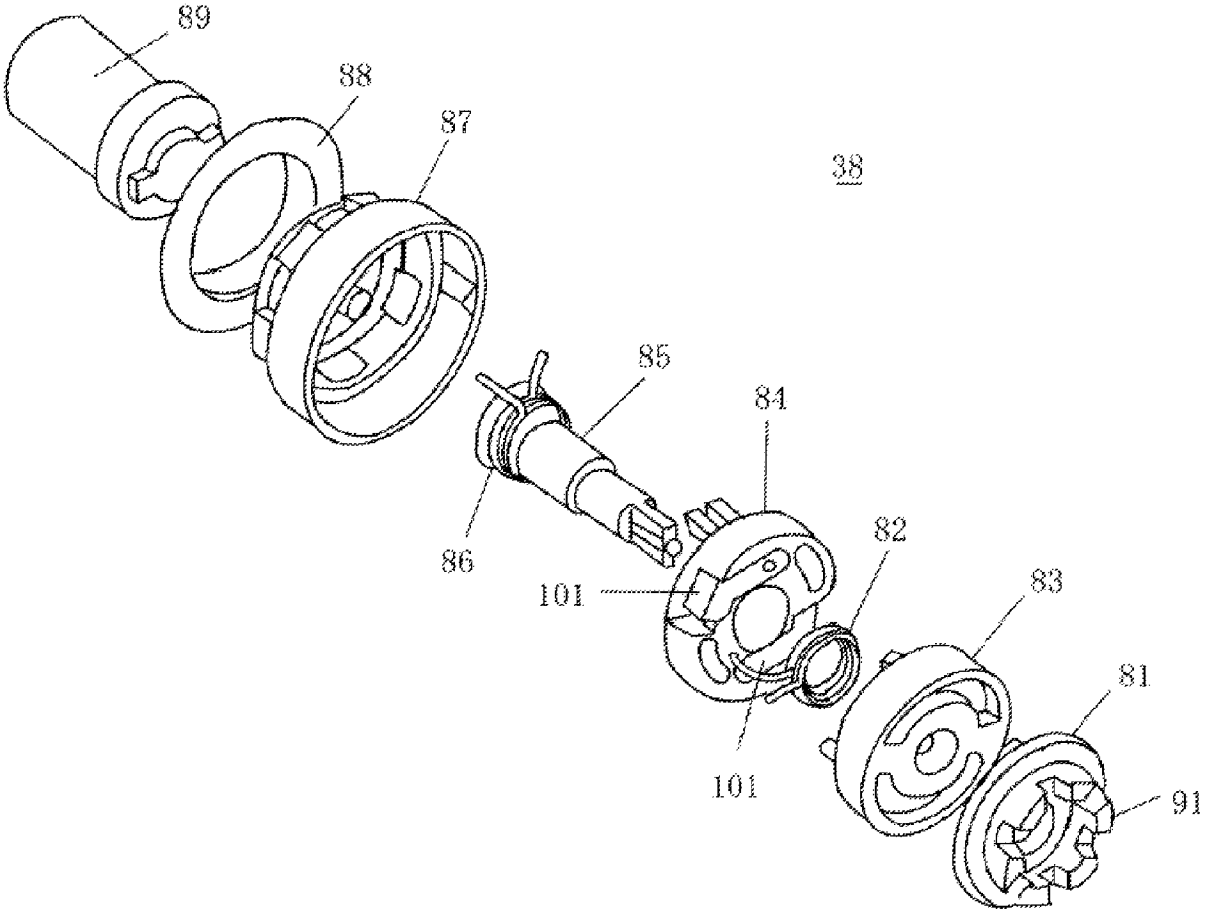
FIG. 4 is an exploded view of the first up/down one-way clutch used in the sunlight-shielding devices conforming to the present invention in Examples 1 and 2 (the second up/down one-way clutch also has roughly the same structure).

FIG. 3*b* is a perspective view showing the exterior of the first up/down one-way clutch 38, while FIG. 4 is an exploded view of the first up/down one-way clutch 38. The first up/down one-way clutch 38 has a concentrically positioned input disk 81, return spring 82, input plate 83, top plate 84, center pin 85, retainer spring 86, output drum 87, sleeve 88, and drum joint 89.

The center pin 85 is fixed to the head box 2 as deemed appropriate. Around this center pin 85, the input disk 81, input plate 83, top plate 84, center pin 85 and output drum 87 are supported by a shaft in a rotatable manner.

The input disk 81 is constantly meshing with the inner surface of the first driving gear 35 at a meshing part 91 on its outer surface, and rotates together with the first driving gear 35. A pair of projections 93 are provided symmetrically over the shaft center on an inner surface 92 of the input disk 81 (refer to FIG. 5*a*).

Take note that, in this Specification and present invention, the term "inner" in "inner surface," "inner side," etc., refers to the center side in the width direction of the sunlight-shielding device 1 when the sunlight-shielding device 1 is viewed from the front. Similarly, the term "outer" in "outer surface," "outer side," etc., refers to the outer side in the width direction of the sunlight-shielding device 1 when the sunlight-shielding device 1 is viewed from the front.

Figure 5A:
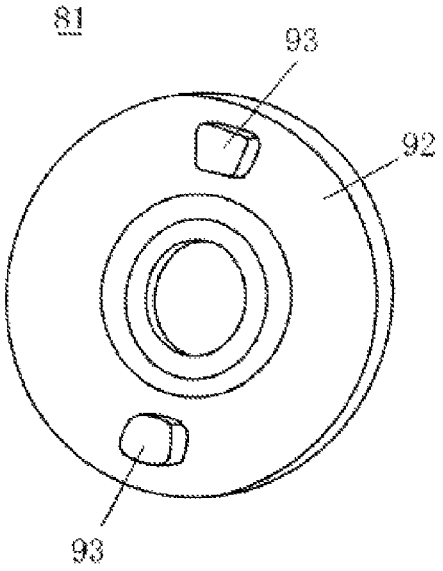
FIGS. 5*a* to 5*d* are perspective views showing the structure of each part of the first up/down one-way clutch used in the sunlight-shielding devices conforming to the present invention in Examples 1 and 2 (the second up/down one-way clutch also has roughly the same structure).
Figure 5B:
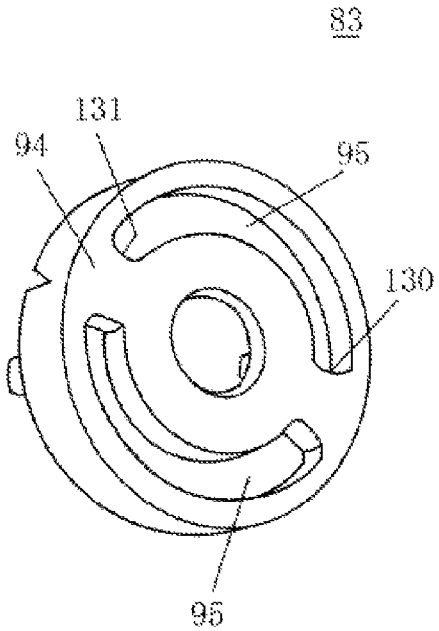
Figure 5C:
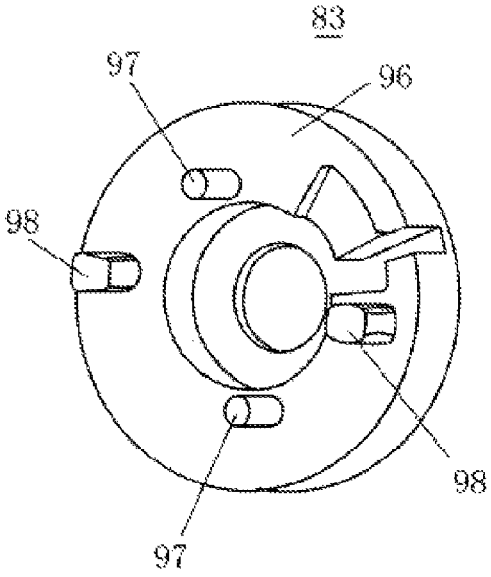
Figure 5D:
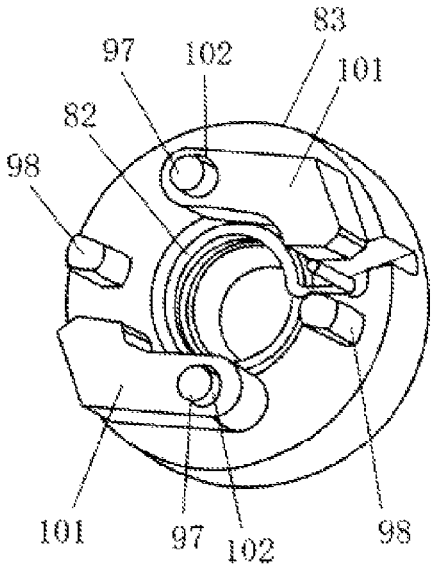
Figure 6A:
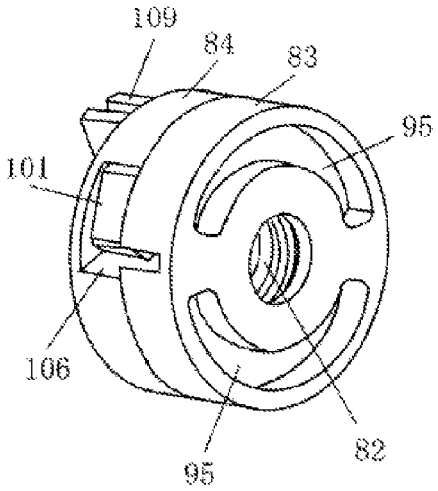
FIGS. 6*a* to 6*d* are perspective views showing the structure of each part of the first up/down one-way clutch used in the sunlight-shielding devices conforming to the present invention in Examples 1 and 2 (the second up/down one-way clutch also has roughly the same structure).

The input plate 83 has a pair of curved grooves 95 formed on an outer surface 94, extending in the circumferential direction symmetrically over the shaft center (refer to FIGS. 5*b* and 6*a*). The pair of projections 93 on the input plate 81 are engaged with this pair of curved grooves 95 in a manner movable in the circumferential direction. On an inner surface 96 of the input plate 83, a pair of pivot shafts 97 and pair of drive projections 98 are provided symmetrically over the shaft center (refer to FIGS. 5*c* and 5*d*).

As shown in FIGS. 5*d*, 6*b*, and 7*a* to 7*c*, the engagement top 101 has roughly the shape of an "L" in plan view, and two pieces are provided as a pair. The engagement top 101 has a pivot hole 102 formed at its base and an engagement part 103 at its tip. As shown in FIG. 5*d*, the engagement top 101 is pivoted with the pivot shaft 97 of the input plate 83 engaged with its pivot hole 102.

On an outer surface 105 of the top plate 84, a pair of top guide grooves 106 are formed in parallel in opposite directions over the shaft center, and a pair of curved drive projection-receiving grooves 107 are also formed (refer to FIGS. 6*b* and 7*a* to 7*c*). This top guide groove 106 has roughly the same shape as the engagement top 101 in plan view, and receives and engages with the engagement top 101 and holds it in a manner slidable in its longitudinal direction.

Figure 6B:
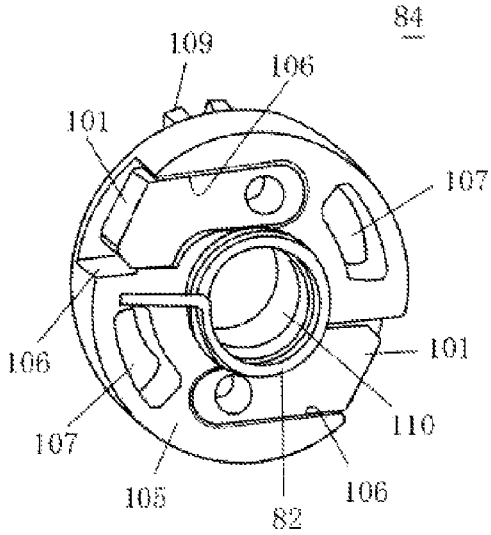
Figure 7A:
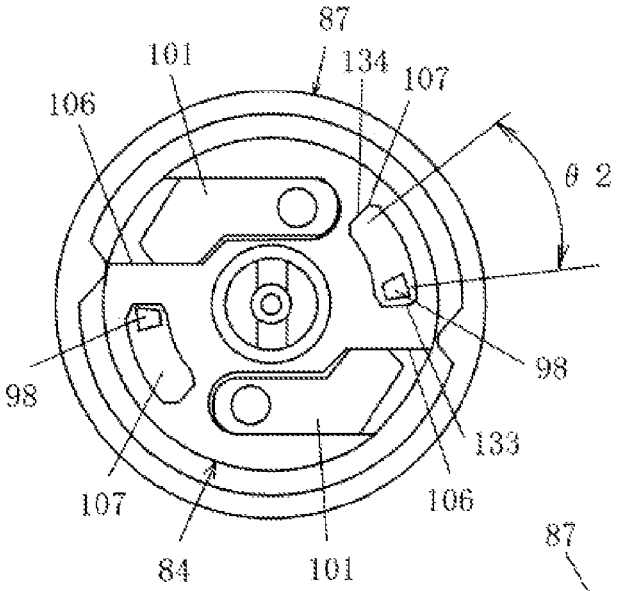
FIGS. 7*a* to 7*c* are drawings showing the structure of each part of the first up/down one-way clutch used in the sunlight-shielding devices conforming to the present invention in Examples 1 and 2 (the second up/down one-way clutch also has roughly the same structure).
Figure 7B:
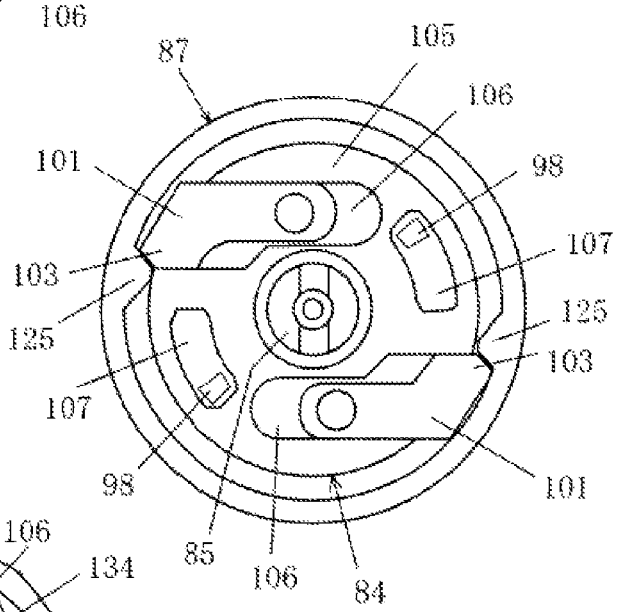
Figure 7C:
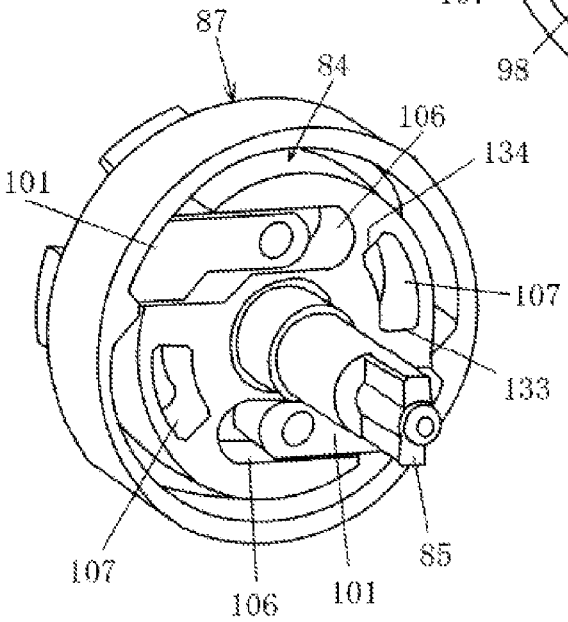

As it slides, the engagement top 101 changes its state from being stored in the area of the top plate 84 inside the top guide groove 106 (refer to FIGS. 6*b* and 7*a*) to projecting out of the area of the top plate 84 (refer to FIGS. 7*b*, 7*c*). The pair of drive projections 98 is engaged with the pair of drive projection-receiving grooves 107 on the top plate 84 in a manner movable in the circumferential direction. The drive projection-receiving groove 107 is formed in the circumferential direction over a 30° angle range.

Figure 6C:
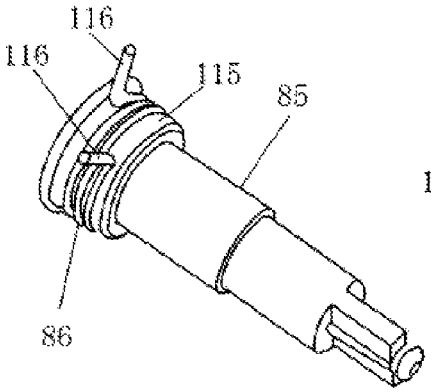
Figure 6D:
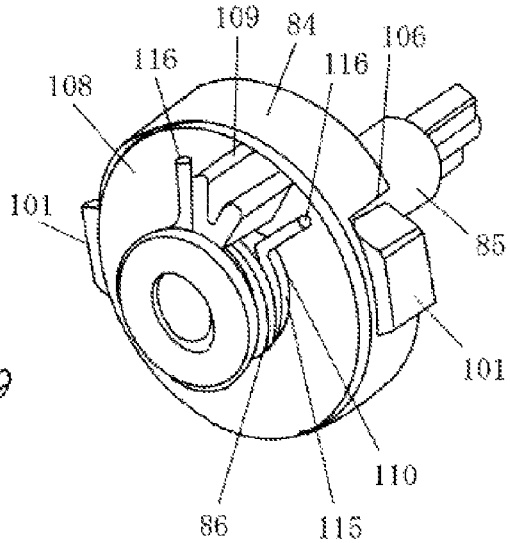

As shown in FIG. 6*d*, a regulating projection 109 having a V shape in side view is provided on an inner surface 108 of the top plate 84. The regulating projection 109 extends radially from the center on the outer side of a shaft hole 110 running through the center of the top plate 84. The center pin 85 is inserted through the shaft hole 110, and a boss 115 of the center pin 85 projects from the inner surface 108 of the top plate 84.

As shown in FIGS. 5*d* and 6*b*, the return spring 82 constituted by a torsion spring is wound coaxially around the center pin 85 between the input plate 83 and top plate 84. One end of the return spring 82 is attached to the input plate 83, while the other end is attached to the top plate 84.

The return spring 82 biases elastic forces to the input plate 83 and top plate 84 so that they repel each other in circumferentially opposite directions. The return spring 82 biases forces in such a way that, normally, the engagement top 101 is moved to the deepest pulled-in position inside the top guide groove 106 via the pivot shaft 97, so as to pull it into the area of the top plate 84, as shown in FIGS. 6*b* and 7*a*.

As shown in FIG. 7*a*, the drive projection 98 of the return spring 82 is normally positioned on a base end 133 side of the drive projection-receiving groove 107, and the input plate 83 and top plate 84 are coupled in a rotatable manner with play in between in the rotating direction. Accordingly, the drive projection 98 does not immediately contact the top plate 84 when the input plate 83 starts rotating counterclockwise, and therefore a slight idle period is created momentarily during which only the input plate 83 slips and rotation is not transmitted to the top plate 84.

As shown in FIGS. 6*c* and 6*d*, the coil-shaped retainer spring 86 exerting an elastic force to tighten the boss 115 is installed (wound) around the boss 115 of the center pin 85. Two feet 116 on both ends of the retainer spring 86 are bent in the radius direction and project. The positional relationship is such that the V-shaped regulating projection 109 is positioned between the two feet 116 (refer to FIG.6*d*).

The output drum 87 is made of metal and is supported in a rotatable manner by a resin case (not illustrated) installed in the head box 2. The sleeve 88 is inserted between the output drum 87 and resin case in order to prevent wear of the part that functions as the bearing of the resin case that supports the output drum 87 in a rotatable manner.

Figure 8A:
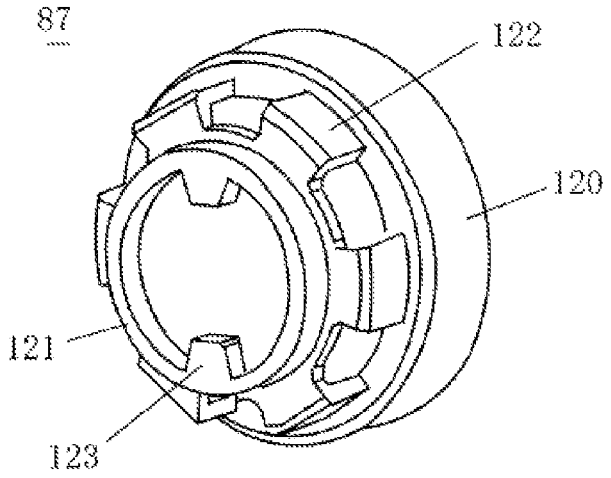
FIGS. 8*a* to 8*c* are perspective views showing the structure of each part of the one-way clutch device used in the sunlight-shielding devices conforming to the present invention in Examples 1 and 2.
Figure 8B:
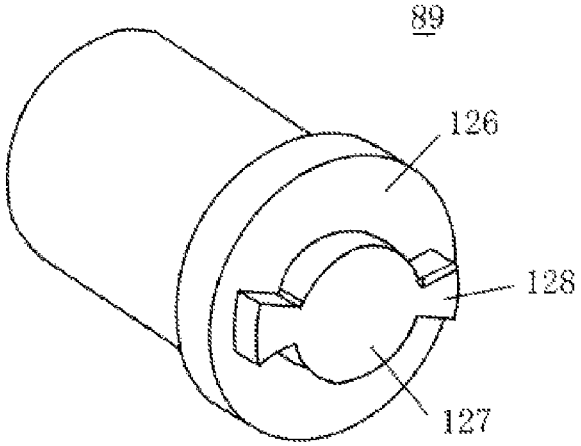
Figure 8C:
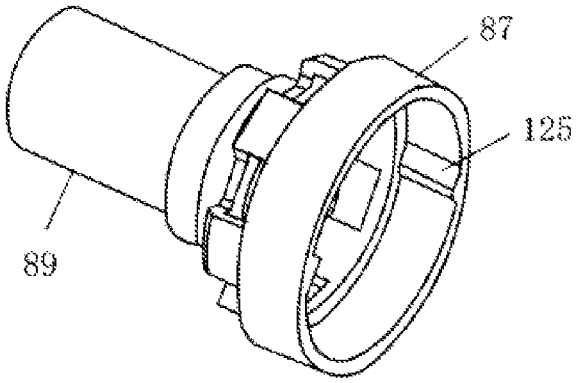

As shown in FIG. 8*a*, the output drum 87 comprises a cylindrical part 120 positioned on the outer side of the sunlight-shielding device 1 in the width direction, an annular part 121 positioned on the inner side, and a connection part 122 that connects the cylindrical part 120 and annular part 121. The top plate 84 is concentrically positioned in the cylindrical part 120, as shown in FIG. 7*c*.

As shown in FIGS. 7*a* to 7*c*, the pair of engagement projection strips 125 are formed symmetrically over the shaft center at positions 180° apart in the circumferential direction on the inner periphery surface of the cylindrical part 120. The engagement parts 103 of the pair of engagement tops 101 can be engaged with/separated from this pair of engagement projection strips 125, as shown in FIGS. 7*a* to 7*c*. As shown in FIG. 8*a*, a pair of engagement projections 123 are formed symmetrically over the shaft center at positions 180° apart in the circumferential direction on the inner periphery surface of the annular part 121 of the output drum 87.

The drum joint 89 is a member that transmits to the first up/down cord wind-up drum 70 via the first up/down drive shaft 21 the rotational output transmitted by the first up/down one-way clutch. Although not illustrated, a fixing hole through which to fix the first up/down drive shaft 21 to the shaft center is formed at the inner end of the drum joint 89, with the first up/down drive shaft 21 fixed concentrically.

A flange 126 is formed at the outer end of the drum joint 89. A projection part 127 of approximate circular shape that projects outward is formed on the outer end face of this flange 126. This projection part 127 is positioned concentrically in the annular part 121.

A pair of projections 128 projecting in the diameter direction is formed on the projection part 127. The pair of projections 128 is provided at positions 180° apart. While the projection part 127 is rotatable in the annular part 121 of the output drum 87, the pair of projections 128 is structured in a manner engageable with the pair of engagement projections 123 on the output drum 87.

(Operation)

The operation of the sunlight-shielding device 1 in the example having the aforementioned structure is explained below by referring to FIGS. 1*a* to 12. The first up/down one-way clutch 38 and second up/down one-way clutch 39 have roughly the same structure and operation, although the direction of rotation accommodated by each is different, and therefore the operation of the first up/down one-way clutch 38 operated to move the first shielding material 3 up and down is primarily explained below.

Figure 11:
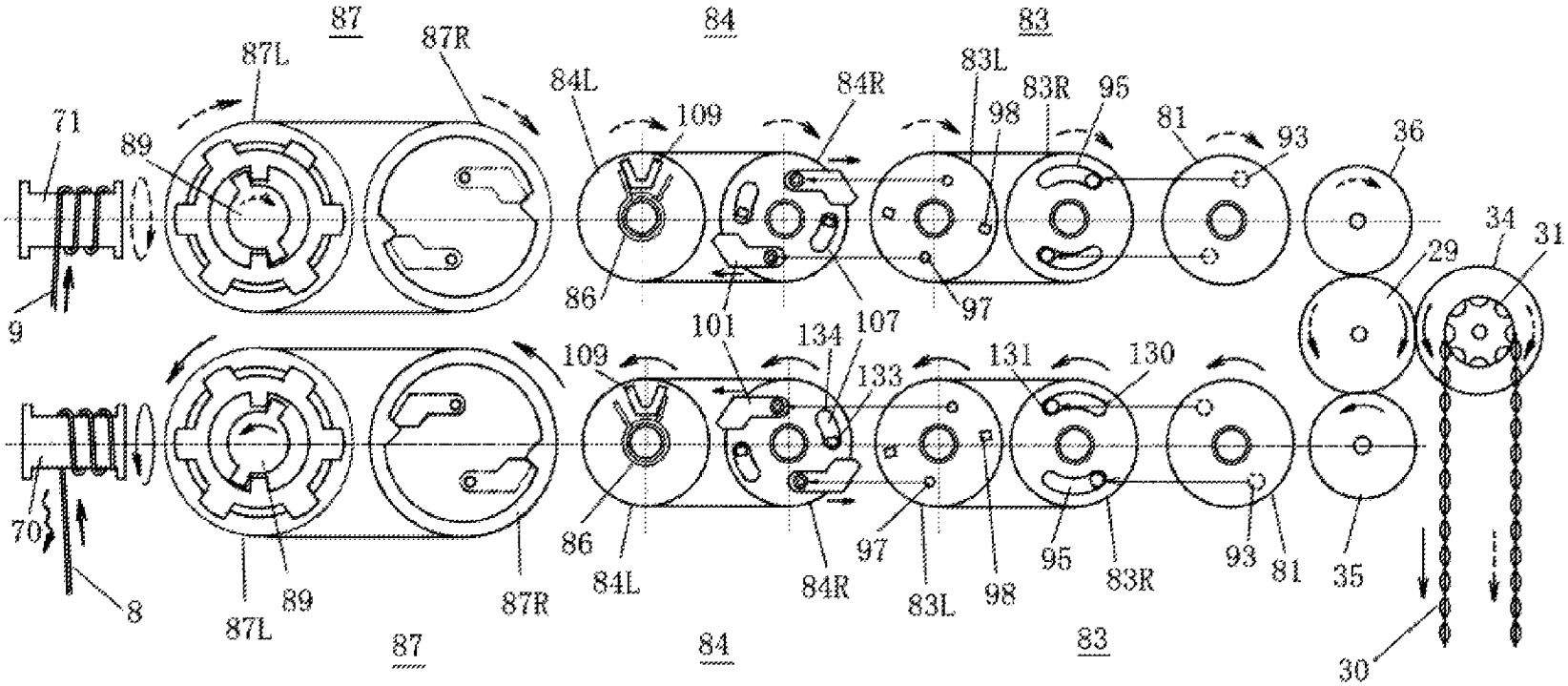
FIG. 11 is a schematic view explaining the operation of the sunlight-shielding device conforming to the present invention in an example.

FIGS. 10 and 11 are each a schematic view explaining the operation of the up/down clutch, where FIG. 10 shows the condition where the first up/down one-way clutch 38 is not transmitting rotation to the output drum 87 (the moment the operation cord starts being pulled down or the operation cord is not pulled at all), while FIG. 11 shows the condition where rotation is transmitted to the output drum 87. The solid-line arrows indicate the movement of the first up/down one-way clutch 38, while the broken-line arrows indicate the movement of the second up/down one-way clutch 39.

In FIGS. 10 and 11, the side faces of the input plate 83, top plate 84, and output drum 87 are denoted by 83R, 84R, and 87R, respectively, as viewed from the outer side of the sunlight-shielding device 1 in the width direction, while their side faces as viewed from the center side of the sunlight-shielding device 1 in the width direction are denoted by 83L, 84L, and 87L, respectively, with the two side faces of each part connected by a solid line for convenience.

Figure 12:
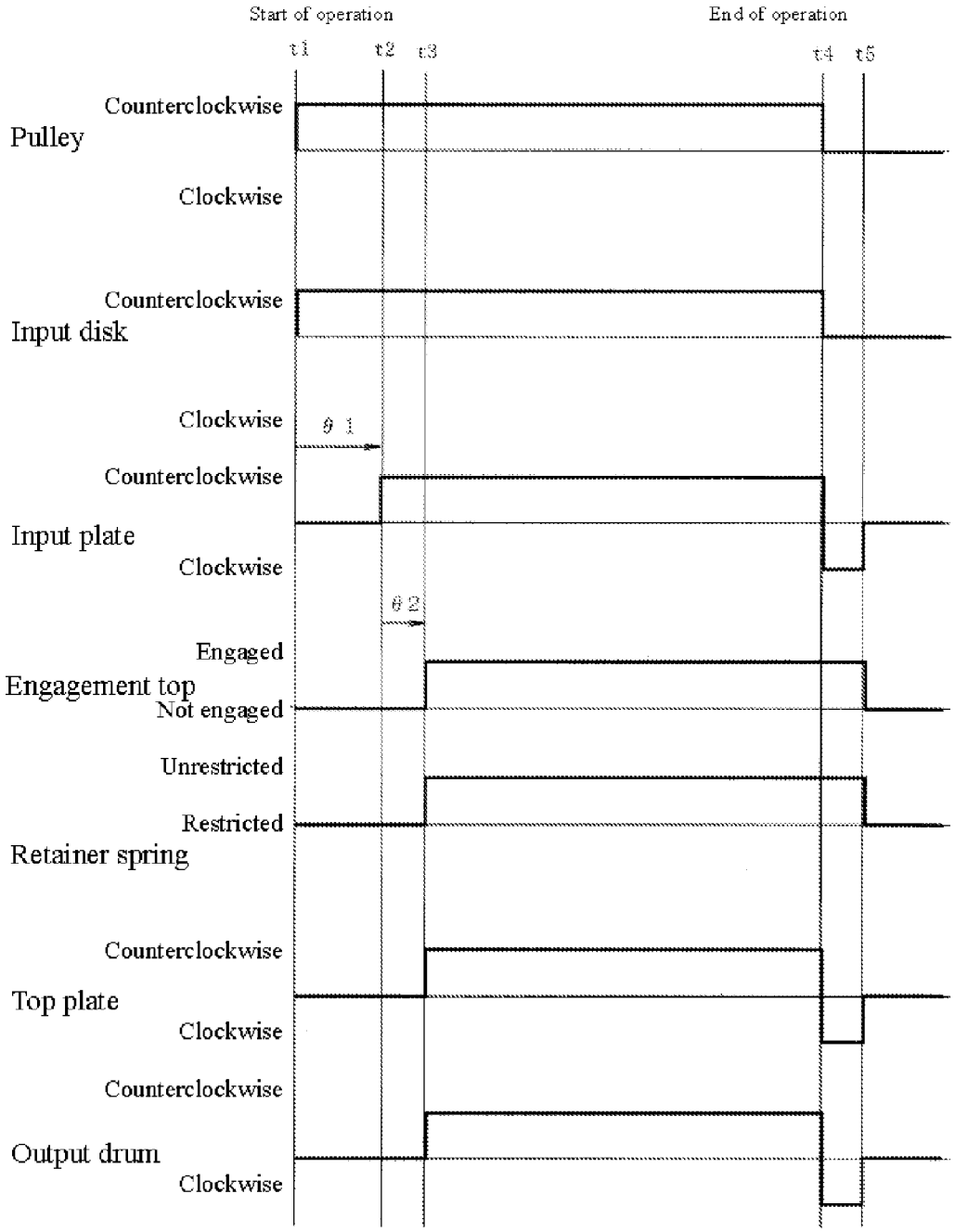
FIG. 12 is a timing chart explaining the operation of the one-way clutch device used in the sunlight-shielding devices conforming to the present invention in Examples 1 and 2.

FIG. 12 is a timing chart showing the operation of each part of the first up/down one-way clutch 38, where progression of time is indicated in the lateral direction, with t1 to t5 each representing an operation timing.

Now, when one side of the looped operation cord 30 is pulled down (direction of the solid-line arrow in FIG. 10 or 11) and pulley gear 34 is rotated in the counterclockwise direction, the first driving gear 35 rotates in the counterclockwise direction via the intermediate gear 29. As the first driving gear 35 rotates in the counterclockwise direction, the constantly meshed input disk 81 rotates in the counterclockwise direction (refer to timing t1 in FIG. 12).

As the input disk 81 rotates in the counterclockwise direction, the projection 93 moves from a base end 130 side in the counterclockwise direction inside the curved groove 95 of the input plate 83. During this movement, the rotation of the input disk 81 is not transmitted to the input plate 83 (refer to FIG. 10). As the input disk 81 rotates by angle θ1 and the projection 93 contacts a tip 131 of the curved groove 95, the input plate 83 starts rotating in the counterclockwise direction (refer to FIG. 11 and timing t2 in FIG. 12).

As the input plate 83 rotates in the counterclockwise direction, the drive projection 98 rotates by angle θ2(30°) from the base end 133 side in the counterclockwise direction inside the drive projection-receiving groove 107, but during this movement the top plate 84 is not rotated by the drive projection 98 and slipping occurs (refer to FIG. 10). On the other hand, the pivot shaft 97 of the input plate 83 also moves counterclockwise in the circumferential direction. This serves to rotate the top plate 84 in the counterclockwise direction, together with the input plate 83, via the engagement top 101.

However, the retainer spring 86 is wound and fastened elastically around the boss 115 of the center pin 85 and the regulating projection 109 of the top plate 84 contacts the feet 116 of this retainer spring 86 to restrict the rotation of the top plate 84, and therefore the top plate 84 does not rotate jointly with the input plate 83.

Since the top plate 84 is thus restricted in a non-rotating state, as the input plate 83 rotates in the counterclockwise direction the engagement top 101 alone is pushed by the pivot shaft 97 and pushed out of the top plate 84 along the top guide groove 106. As a result, the engagement part 103 of the engagement top 101 engages with the engagement projection strip 125 of the output drum 87, as shown in FIGS. 7*b* and 7*c* (refer to timing t3 in FIG. 12).

At the same time this engagement top 101 is pushed out of the top plate 84 along the top guide groove 106, the drive projection 98 moves by 30° in the circumferential direction inside the drive projection-receiving groove 107, as mentioned above, and contacts a tip 134 of the drive projection-receiving groove 107 as shown in FIGS. 7*b* and 7*c*. This way, the counterclockwise rotational force of the input plate 83 is provided to the top plate 84 (refer to timing t3 in FIG. 12).

Accordingly, the regulating projection 109 pressures the feet 116 of the retainer spring 86 more strongly in the circumferential direction by resisting their elastic force, and the retainer spring 86 effectively loosens the tightened boss 115 of the center pin 85. As a result, the restriction of the top plate 84 by the retainer spring 86 is cancelled, and the retainer spring 86 and top plate 84 start rotating in the counterclockwise direction together with the input plate 83 (refer to timing t3 in FIG. 12).

As mentioned above, as the engagement part 103 of the engagement top 101 engages with the engagement projection strip 125 of the output drum 87, the counterclockwise rotation of the top plate 84 is transmitted to the output drum 87, and the output drum 87 also rotates in the counterclockwise direction (refer to timing t3 in FIG. 12).

After the output drum 87 rotates by angle θ3 (roughly a little less than one-half rotation) in the counterclockwise direction, the engagement projection 123 of the output drum 87 engages with the projection 128 of the drum joint 89 and the drum joint 89 rotates in the counterclockwise direction. Accordingly, the first up/down cord wind-up drum 70 rotates via the first up/down drive shaft 21 and the first shielding material 3 rises.

Play Between the Input Disk and Input Plate in the Rotating Direction:

The operation of the first up/down one-way clutch 38 in raising the first shielding material 3 was explained above. One characteristic of this first up/down one-way clutch 38 is that the projections 93 on the input disk 81 engage with the pair of curved grooves 95 formed on the input plate 83 in a manner movable in the circumferential direction, and the input disk 81 and input plate 83 are coupled in a rotatable manner with play in between in the rotating direction, so that transmission to the input plate 83 occurs after a slip period where only the input disk 81 slips. The significance of providing play between the input disk 81 and input plate 83 in the rotating direction is explained below.

If the hand is released from the up/down operation cord 30 while the up/down operation cord 30 is pulled in one direction to rotate the pulley in the counterclockwise direction and the first shielding material 3 is rising, as mentioned above, the first shielding material 3 will start to drop due to its dead weight and clockwise rotation will be transmitted to the output drum 87 via the first up/down drive shaft 21 and drum joint 89 (refer to timing t4 in FIG. 12).

Here, the engagement top 101 is still projecting out of the top plate 84 and engaged with the engagement projection strip 125, as shown in FIGS. 7*b* and 7*c*, the moment the hand is released from the up/down operation cord while the first shielding material 3 is rising and the material starts to drop, as mentioned above. In other words, by releasing the hand from the up/down operation cord 30, counterclockwise rotational force no longer applies to the engagement top 101 and therefore even when the bias force of the return spring 82 is applied via the pivot shaft 97 of the input plate 83, the engagement top 101 does not instantly return to the pulled-in position inside the input plate 83 because of the frictional force with the top guide groove 106, among others.

As a result, when the first shielding material 3 starts to drop due to its dead weight and the output drum 87 rotates in the clockwise direction, as mentioned above, the top plate 84 also rotates in the clockwise direction via the engagement top 101 (refer to FIG. 12). Here, without the structure of coupling with play where the pair of projections 93 on the input disk 81 engages with the pair of curved grooves 95 formed on the input plate 83 in a manner movable in the circumferential direction, the counterclockwise rotation of the top plate 84 is transmitted to the second input plate 83 as clockwise rotation via the input disk 81, first driving gear 35, intermediate gear 29, and second driving gear 36.

In essence, an attempt is made to transmit to the second input plate 83 the clockwise rotation to raise the second shielding material 5. However, clockwise rotation of the second input plate 83 is stopped due to the dead weight of the second shielding material 5, and consequently the first shielding material 3 cannot drop. The result is a limbo state where the stopping effect of the first up/down stopper device 24 described later also does not work.

In this case, if the dead weight of the second shielding material 5 is relatively larger than the dead weight of the first shielding material 3, the dead weight of the second shielding material 5 causes the counterclockwise rotation to be transmitted to the second driving gear 36 via the second up/down drive shaft 25 and second up/down one-way clutch 39, and this is transmitted to the second driving gear 36 via the intermediate gear 29 and consequently the first shielding material may even rise instead of dropping.

In essence, the first shielding material 3 will not drop even when the hand is released from the up/down operation cord 30 while the first shielding material 3 is rising, and the operation of the first shielding material 3 will become extremely unstable, rising against intention depending on the magnitude correlation of the dead weights of the first shielding material 3 and second shielding material, or remaining in a limbo state because the stopping effect of the stopper 24 does not work.

With the sunlight-shielding device 1 under the present invention, however, the structure is such that the projections 93 on the input disk 81 engage with the pair of curved grooves 95 formed on the input plate 83 in a manner movable in the circumferential direction, and the input disk 81 and input plate 83 are coupled in a rotatable manner with play in between in the rotating direction, and consequently the aforementioned unstable operation can be prevented as explained below.

Specifically, when the hand is released from the up/down operation cord 30 while the first shielding material 3 is rising (refer to timing t4 in FIG. 12), as mentioned above, the first shielding material 3 starts to drop due to its dead weight and clockwise rotation is transmitted to the output drum 87 via the drum joint 89, and subsequently the top plate 84 rotates in the clockwise direction, while the projections 93 on the input disk 81 can move with play in the curved grooves 95 of the input plate 83.

In essence, even when the rotational force (or rotational resistance force) due to the dead weight of the second shielding material is transmitted to the input disk 81 as a counterclockwise rotational force via the second driving gear 36, intermediate gear 29, and first driving gear 35, the input plate 83 can rotate in the clockwise direction with play instead of being blocked by the counterclockwise rotational force. As a result, the first shielding plate 3 can drop and thus drops a little, and then stops due to the first up/down stopper device 24 described later (refer to timing t5 in FIG. 12).

During the slip period where the input plate 83 rotates clockwise with play, the engagement top 101 moves in the top guide groove 106 and returns to the pulled-in position inside the input plate 83 by means of the return spring 82. As a result, the clockwise rotation of the input plate 83 does not transmit to the input disk 81. The dropping operation of the first shielding material 3 is not affected by the dead weight of the second shielding material 5, either.

Play Between the Output Drum and Drum Joint:

The projection part 127 of the drum joint 89 rotates inside the annular part 121 of the output drum 87. The structure is such that, as the output drum 87 rotates by angle θ3 (roughly a little less than one-half rotation) relative to the drum joint 89, the pair of engagement projections 123 on the output drum 87 engages with the pair of projections 128 on the drum joint 89. In essence, the drum joint 89 and output drum 87 have a sufficient clearance (play) in between.

This structure means that, as the first shielding material 3 drops, the drum joint 89 and output drum 87 can rotate at low resistance because there is a sufficient clearance in between, even when the first up/down drive shaft 36 is bent or otherwise the drum joint 89 is decentered and rattles during rotation.

Operation of the Stopper Device:

While the first up/down drive shaft 21 is rotating in the counterclockwise direction with the operation cord 30 pulled in one direction, the rotating elements 54 rotate and move in the right side groove 56 of the up/down cam shaft 50 and in the vertical groove 53 of the up/down cam shaft 50. Then, when the hand is released, the rotating elements 54 enter the V-shaped groove 58 from the right side groove 56 and stop at the concave part 59. This stops the rotation of the first up/down drive shaft 21, and therefore the first shielding material 3 stops dropping halfway.

To drop the first shielding material 3, the operation cord 30 is pulled slightly in one direction (in the direction of the solid-line arrow in FIG. 10) and then the hand is released, and the rolling elements 54 will roll from the concave part 59 of the up/down cam groove 52 to the V-shaped groove 58 and to the coupling groove 57, and enter the left side groove 55.

Then, the first up/down cord wind-up drum 71 and first up/down drive shaft 21 become rotatable in the clockwise direction due to the dead weight of the first shielding material 3, and the first shielding material 3 drops. It should be noted that, when the first up/down drive shaft 21 rotates in the clockwise direction, the first up/down one-way clutch 38 prevents the counterclockwise rotation from being transmitted toward the first driving gear 35 side. The above operation of the first up/down stopper device 24 applies correspondingly to the second up/down stopper device 25.

EXAMPLE 2

Figure 9A:
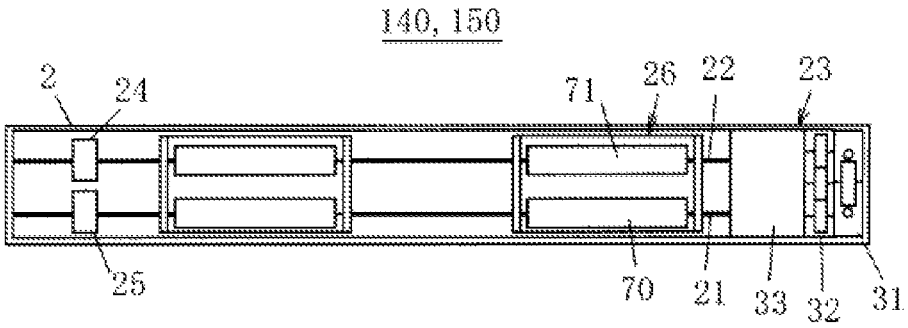
FIGS. 9*a* to 9*c* are drawings explaining the general structure of the twin-type sunlight-shielding device conforming to the present invention in Example 2, where
Figure 9B:
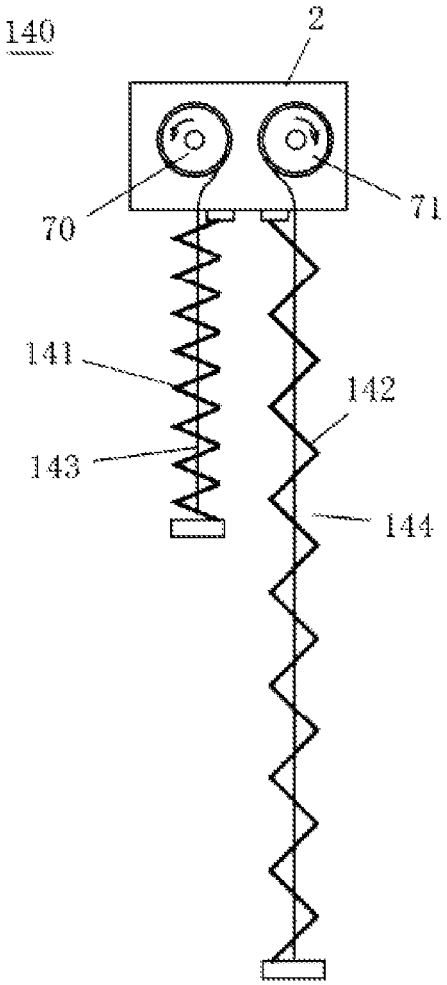
Figure 9C:
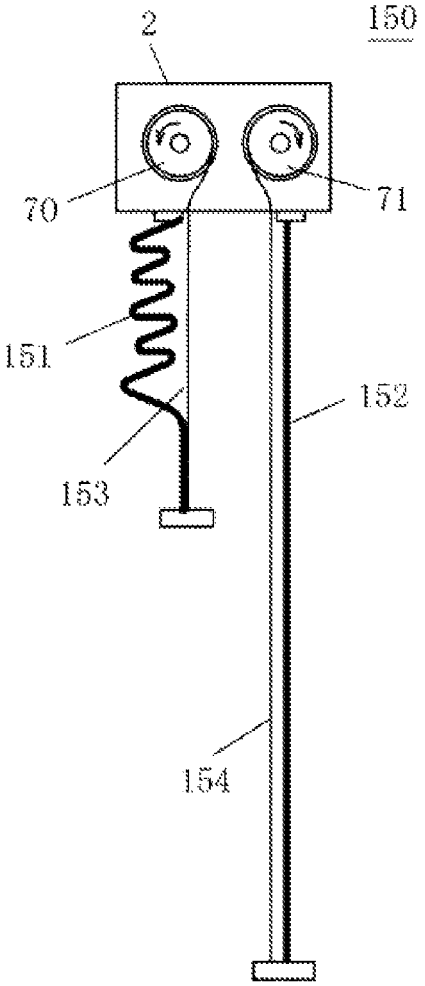

FIGS. 9*a* to 9*c* are drawings showing the general structure of the sunlight-shielding device conforming to the present invention in Example 2. In Example 2, a sunlight-shielding device conforming to the present invention is applied to a pleated screen device and roll-up curtain device having a front shielding material and rear shielding material suspended on the interior side and exterior side, respectively.

FIG. 9*b* is a sunlight-shielding device 140 applied to a pleated screen device. A front shielding material 141 and rear shielding material 142 of the sunlight-shielding device 140 are each a pleated screen and can be moved up and down by winding and unwinding a first up/down cord 143 and second up/down cord 144 onto and out of the first up/down cord wind-up drum 70 and second up/down cord wind-up drum 71, respectively.

FIG. 9*c* is a sunlight-shielding device 150 applied to a roll-up curtain device. A front shielding material 151 and rear shielding material 152 of the sunlight-shielding device 150 are each made of curtain fabric and can be moved up and down by winding and unwinding a first up/down cord 153 and second up/down cord 154 onto and out of the first up/down cord wind-up drum 70 and second up/down cord wind-up drum 71, respectively.

FIG. 9*a* shows the structure of the head box 2 used in the sunlight-shielding devices 140, 150. The structure of the head box 2 is exactly the same as that in Example 1, where the first up/down drive shaft 21 and second up/down drive shaft 22 are positioned in parallel at front and rear positions inside the head box 2.

The pulley operation drive device 23 to drive the first up/down drive shaft 21 and second up/down drive shaft 22 is provided at one end of the head box 2, and further the first up/down stopper device 24 and second up/down stopper device 25 are provided on the first up/down drive shaft 21 and second up/down drive shaft 22, respectively.

Then, the twin wind-up drum devices 26 that are driven and rotated by the driving forces of the first up/down drive shaft 21 and second up/down drive shaft 22 are provided on the left and right. Also, in Example 2, the first up/down drive shaft 21 and second up/down drive shaft 22 rotate in opposite directions as in Example 1.

The pulley operation drive device 23 is a device that drives and rotates each of the first up/down drive shaft 21 and second up/down drive shaft 22 when the operation cord 30 constituted by a looped ball chain is pulled. The pulley operation drive device 23 has the pulley 31, rotational force transmission mechanism 32, and one-way clutch device 33, and the structures and operations thereof are exactly the same as in Example 1 and therefore not explained here.

The foregoing explained modes for carrying out the sunlight-shielding device proposed by the present invention, but the present invention is not at all limited to these examples and it goes without saying that there are various other examples within the scope of technical items described in "What Is Claimed Is."

Industrial Field of Application

Having the aforementioned structure, the sunlight-shielding device proposed by the present invention can be applied to a pleated screen device, shutter device, blind device, or other sunlight-shielding device 1 in which two shielding materials suspended from a head box are switched, using a single-loop up/down operation cord, to be moved up and down independently.

DESCRIPTION OF THE SYMBOLS

1 Twin-type sunlight-shielding device
2 Head box
3 First shielding material
4 Intermediate rail
5 Second shielding material
6 Bottom rail
7 Up/down cord hole
8 First up/down cord
9 Second up/down cord
21 First up/down drive shaft
22 Second up/down drive shaft
23 Pulley operation drive device
24 First up/down stopper device
25 Second up/down stopper device
26 Twin wind-up drum device
29 Intermediate gear
30 Operation cord
31 Pulley
32 Rotational force transmission mechanism
33 One-way clutch device
34 Pulley gear
35 First driving gear
36 Second driving gear
38 First up/down one-way clutch
39 Second up/down one-way clutch
50 Cam shaft
51 Cam case
52 Cam groove
53 Cam case vertical groove
54 Rolling element
55 Left side groove
56 Right side groove
57 Coupling groove
58 V-shaped groove
59 Concave part
70 First up/down cord wind-up drum
71 Second up/down cord wind-up drum
81 Input disk
82 Return spring
83 Input plate
84 Top plate
85 Center pin
86 Retainer spring
87 Output drum
88 Sleeve
89 Drum joint
91 Input disk meshing part
92 Input disk inner surface
93 Input disk projection
94 Input plate outer surface
95 Input plate curved groove
96 Input plate inner surface
97 Input plate pivot shaft
98 Input plate drive projection
101 Engagement top
102 Engagement top pivot hole
103 Engagement top engagement part
105 Top plate outer surface
106 Top plate top guide groove
107 Top plate drive projection-receiving groove
108 Top plate inner surface
109 Top plate V-shaped regulating projection
110 Top plate shaft hole
115 Center pin boss
116 Two retainer spring feet at both ends
120 Output drum cylindrical part
121 Output drum annular part
122 Output drum connection part
123 Annual part engagement projection
125 Output drum engagement projection strip

126 Drum joint flange
127 Drum joint projection part
128 Projection at drum joint projection part
130 Base end of input plate curved groove
131 Tip of input plate curved groove
133 Base end of top plate drive projection-receiving groove
134 Tip of top plate drive projection-receiving groove
140, 150 Sunlight-shielding device
141, 151 First shielding material
142, 152 Second shielding material
143, 153 First up/down cord
144, 154 Second up/down cord

What is claimed is:

1. A sunlight-shielding device comprising:

a head box;

a first shielding material, and second shielding material suspended from the head box and moved up and down by a first up-and-down cord and second up-and-down cord, respectively;

a first up-and-down cord wind-up drum and second up-and-down cord wind-up drum provided in the head box; and a pulley operation drive device, wherein:

the pulley operation drive device has a pulley driven and rotated in a selected rotating direction using an operation cord; and a first up-and-down one-way clutch and second up-and-down one-way clutch that transmit rotations of the pulley in an opposite direction of first direction and second direction to the first up-and-down cord wind-up drum and second up-and-down cord wind-up drum, respectively;

the first up-and-down one-way clutch and second up-and-down one-way clutch each have an input disk, input plate, top plate, and output drum provided rotatably on a center pin;

the input disk and input plate are coupled with idle therebetween in a rotating direction;

the top plate has a guide groove that rotatably holds an engagement top; and the engagement top is pivoted on the input plate and always biased by a return spring provided between the input plate and top plate in a direction of holding the engagement top inside the guide groove of the top plate, wherein the input plate is rotated in a predetermined direction by the input disk which rotates by a rotational force of the pulley, whereby the engagement top projects from the top plate along the guide groove and engages with an engagement projection strip on the output drum to transmit a rotation of the input plate to the output drum.

2. A sunlight-shielding device according to claim 1, wherein:

the input plate has a pivot shaft and drive projection on an inner surface and the engagement top is pivoted on the pivot shaft;

the top plate has on an outer surface the guide groove that slidably holds the engagement top, and a curved drive projection-receiving groove running in a circumferential direction,. and the top plate also has a regulating projection on an inner surface;

the return spring provided between the input plate and top plate biases the input plate and top plate in opposite rotating directions;

a retainer spring for tightening the center pin is wound on the center pin, and feet on both ends of the retainer spring are positioned on both sides of the regulating projection of the top plate and are contactable with both sides of the regulating projection; and the output drum has the engagement projection strip formed on an inner periphery surface.

3. A sunlight-shielding device according to claim 1, wherein:

the output drum has a cylindrical part on an outer side and an annular part on an inner side, wherein the top plate is rotatably arranged concentrically in the cylindrical part, and the engagement projection strip is formed on an inner periphery surface of the cylindrical part.

4. A sunlight-shielding device according to claim 3, wherein:

an engagement projection is formed on an inner periphery surface of the annular part of the output drum, and a drum joint that is rotatable within the annular part is provided concentrically with the output drum, wherein the drum joint has a projection formed on it, which projection engages with the engagement projection of the annular part of the output drum to couple the output drum and drum joint with idle therebetween in a rotating direction.

5. A sunlight-shielding device according to claim 1, wherein:

the first up-and-down one-way clutch and second up-and-down one-way clutch are connected to the first up-and-down cord wind-up drum and second up-and-down cord wind-up drum by a first up-and-down drive shaft and second up-and-down drive shaft, respectively; and a first up-and-down stopper device and second up-and-down stopper device are provided at positions along the first up-and-down drive shaft and second up-and-down drive shaft, respectively.

6. A sunlight-shielding device according to claim 5, wherein:

the first up-and-down stopper device and second up-and-down stopper device each have a cam shaft fixed coaxially to the first up-and-down drive shaft and second up-and-down drive shaft, and a cam case that rotatably supports the cam shaft; and a cam groove is formed on one of an outer periphery surface of the cam shaft and the cam case, and a vertical groove extending straight in an axial direction is formed on the other, with rolling elements inserted in the cam groove and vertical groove, wherein the operation cord is operated to rotate or stop the first up-and-down drive shaft and second up-and-down drive shaft to thereby move up or down or stop the first shielding material and second shielding material.

7. A sunlight-shielding device according to claim 2, wherein:

the output drum has a cylindrical part on an outer side and an annular part on an inner side, wherein the top plate is rotatably arranged concentrically in the cylindrical part, and the engagement projection strip is formed on an inner periphery surface of the cylindrical part.

8. A sunlight-shielding device according to claim 7, wherein:

an engagement projection is formed on an inner periphery surface of the annular part of the output drum, and a drum joint that is rotatable within the annular part is provided concentrically with the output drum, wherein the drum joint has a projection formed on it, which projection engages with the engagement projection of the annular part of the output drum to couple the output drum and drum joint with idle therebetween in a rotating direction.

9. A sunlight-shielding device according to claim 2, wherein:

the first up-and-down one-way clutch and second up-and-down one-way clutch are connected to the first up-and-down cord wind-up drum and second up-and-down cord wind-up drum by a first up-and-down drive shaft and second up-and-down drive shaft, respectively; and a first up-and-down stopper device and second up-and-down stopper device are provided at positions along the first up-and-down drive shaft and second up-and-down drive shaft, respectively.

10. A sunlight-shielding device according to claim 3, wherein:

the first up-and-down one-way clutch and second up-and-down one-way clutch are connected to the first up-and-down cord wind-up drum and second up-and-down cord wind-up drum by a first up-and-down drive shaft and second up-and-down drive shaft, respectively; and a first up-and-down stopper device and second up-and-down stopper device are provided at positions along the first up-and-down drive shaft and second up-and-down drive shaft, respectively.

11. A sunlight-shielding device according to claim 7, wherein:

the first up-and-down one-way clutch and second up-and-down one-way clutch are connected to the first up-and-down cord wind-up drum and second up-and-down cord wind-up drum by a first up-and-down drive shaft and second up-and-down drive shaft, respectively; and a first up-and-down stopper device and second up-and-down stopper device are provided at positions along the first up-and-down drive shaft and second up-and-down drive shaft, respectively.

12. A sunlight-shielding device according to claim 4, wherein:

the first up-and-down one-way clutch and second up-and-down one-way clutch are connected to the first up-and-down cord wind-up drum and second up-and-down cord wind-up drum by a first up-and-down drive shaft and second up-and-down drive shaft, respectively; and a first up-and-down stopper device and second up-and-down stopper device are provided at positions along the first up-and-down drive shaft and second up-and-down drive shaft, respectively.

13. A sunlight-shielding device according to claim 8, wherein:

the first up-and-down one-way clutch and second up-and-down one-way clutch are connected to the first up-and-down cord wind-up drum and second up-and-down cord wind-up drum by a first up-and-down drive shaft and second up-and-down drive shaft, respectively; and a first up-and-down stopper device and second up-and-down stopper device are provided at positions along the first up-and-down drive shaft and second up-and-down drive shaft, respectively.

14. A sunlight-shielding device according to claim 9, wherein:

the first up-and-down stopper device and second up-and-down stopper device each have a cam shaft fixed coaxially to the first up-and-down drive shaft and second up-and-down drive shaft, and a cam case that rotatably supports the cam shaft; and a cam groove is formed on one of an outer periphery surface of the cam shaft and the cam case, and a vertical groove extending straight in an axial direction is formed on the other, with rolling elements inserted in the cam groove and vertical groove, wherein the operation cord is operated to rotate or stop the first up-and-down drive shaft and second up-and-down drive shaft to thereby move up or down or stop the first shielding material and second shielding material.

15. A sunlight-shielding device according to claim 10, wherein:

the first up-and-down stopper device and second up-and-down stopper device each have a cam shaft fixed coaxially to the first up-and-down drive shaft and second up-and-down drive shaft, and a cam case that rotatably supports the cam shaft; and a cam groove is formed on one of an outer periphery surface of the cam shaft and the cam case, and a vertical groove extending straight in an axial direction is formed on the other, with rolling elements inserted in the cam groove and vertical groove, wherein the operation cord is operated to rotate or stop the first up-and-down drive shaft and second up-and-down drive shaft to thereby move up or down or stop the first shielding material and second shielding material.

16. A sunlight-shielding device according to claim 11, wherein:

the first up-and-down stopper device and second up-and-down stopper device each have a cam shaft fixed coaxially to the first up-and-down drive shaft and second up-and-down drive shaft, and a cam case that rotatably supports the cam shaft; and a cam groove is formed on one of an outer periphery surface of the cam shaft and the cam case, and a vertical groove extending straight in an axial direction is formed on the other, with rolling elements inserted in the cam groove and vertical groove, wherein the operation cord is operated to rotate or stop the first up-and-down drive shaft and second up-and-down drive shaft to thereby move up or down or stop the first shielding material and second shielding material.

17. A sunlight-shielding device according to claim 12, wherein:

the first up-and-down stopper device and second up-and-down stopper device each have a cam shaft fixed coaxially to the first up-and-down drive shaft and second up-and-down drive shaft, and a cam case that rotatably supports the cam shaft; and a cam groove is formed on one of an outer periphery surface of the cam shaft and the cam case, and a vertical groove extending straight in an axial direction is formed on the other, with rolling elements inserted in the cam groove and vertical groove, wherein the operation cord is operated to rotate or stop the first up-and-down drive shaft and second up-and-down drive shaft to thereby move up or down or stop the first shielding material and second shielding material.

18. A sunlight-shielding device according to claim 13, wherein:

the first up-and-down stopper device and second up-and-down stopper device each have a cam shaft fixed coaxially to the first up-and-down drive shaft and second up-and-down drive shaft, and a cam case that rotatably supports the cam shaft; and a cam groove is formed on one of an outer periphery surface of the cam shaft and the cam case, and a vertical groove extending straight in an axial direction is formed on the other, with rolling elements inserted in the cam groove and vertical groove, wherein the operation cord is operated to rotate or stop the first up-and-down drive shaft and second up-and-down drive shaft to thereby move up or down or stop the first shielding material and second shielding material.

* * * * *